US006941997B2

(12) United States Patent
Butler

(10) Patent No.: US 6,941,997 B2
(45) Date of Patent: Sep. 13, 2005

(54) DOOR ASSEMBLY

(75) Inventor: Bruce Butler, Franklin Lakes, NJ (US)

(73) Assignee: Butler Door Compant, Fairfield, NJ (US)

( * ) Notice: Subject to any disclaimer, the term of this patent is extended or adjusted under 35 U.S.C. 154(b) by 0 days.

(21) Appl. No.: 10/762,922

(22) Filed: Jan. 22, 2004

(65) Prior Publication Data

US 2004/0173324 A1 Sep. 9, 2004

Related U.S. Application Data

(60) Provisional application No. 60/441,918, filed on Jan. 22, 2003.

(51) Int. Cl.[7] ..... A47H 1/00

(52) U.S. Cl. ..... 160/92; 49/65; 292/DIG. 2

(58) Field of Search ..... 160/92, 93, 94, 160/95, 96, 97; 49/65; 70/DIG. 65; 292/150, 165, 1, 3, 175, 280, DIG. 1, DIG. 2

(56) References Cited

U.S. PATENT DOCUMENTS 1,100,564 A * 6/1914 Heryford ..... 160/97
1,859,974 A * 5/1932 Kroenke ..... 160/97
2,381,666 A * 8/1945 Hinton et al. ..... 160/95
2,537,896 A * 1/1951 Hinton et al. ..... 292/1
2,604,156 A * 7/1952 Niels ..... 160/92
2,975,830 A * 3/1961 McDonald ..... 160/92
3,722,237 A * 3/1973 Taylor ..... 70/107
4,302,907 A * 12/1981 Canals et al. ..... 49/65
6,109,328 A * 8/2000 Montana et al. ..... 160/92

* cited by examiner

*Primary Examiner*—David Purol
(74) *Attorney, Agent, or Firm*—Gerald E. Hespos; Anthony J. Casella

(57) ABSTRACT

A door assembly includes a barrier door that is hingedly rotatable about an axis of rotation. The door assembly further includes an environmental door that is hingedly rotatable about the axis of rotation. The barrier door and the environmental door can be rotated independently or in unison from opened positions to closed positions. The barrier door has a handle and the environmental door has a hole through which the handle can pass so that the barrier door handle can be accessed through the environmental door. The environmental door also has a cover for selectively closing the handle hole.

14 Claims, 6 Drawing Sheets

FIG. 13
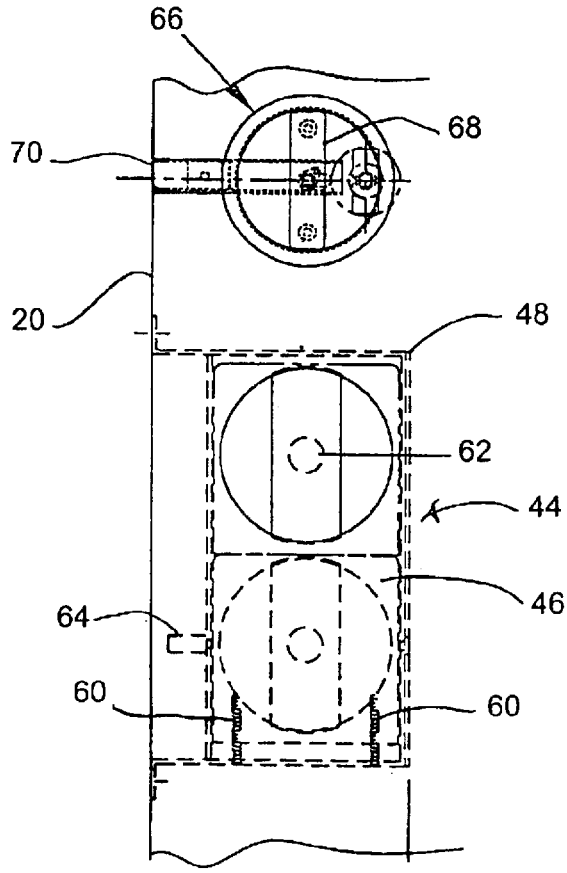
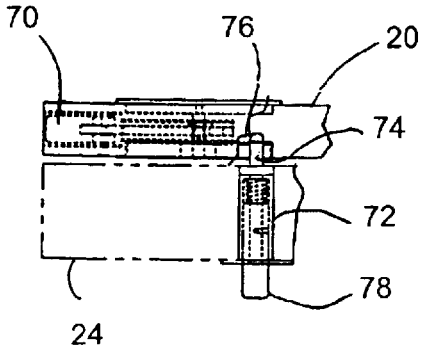
FIG. 14
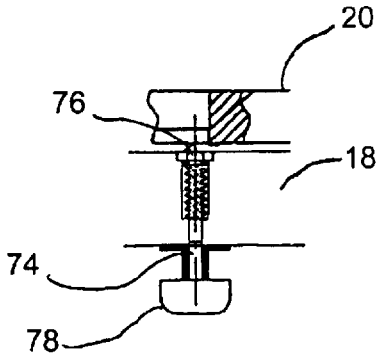
FIG. 15

DOOR ASSEMBLY

This application claims the benefit of U.S. Provisional Application Ser. No. 60/441,918, filed on Jan. 22, 2003.

BACKGROUND OF THE INVENTION

1. Field of the Invention

The invention relates to a door assembly with a barrier door and an environmental door that can be hingedly rotated relative to an opening either independently of one another or in unison.

2. Description of the Related Art

Exterior doorways to most residential buildings and some commercial buildings are provided with a pair of hinged doors. The first door is referred to herein as a barrier door and has sufficient structural integrity to control access to the building. Thus, the barrier door typically will have a lock that can be opened manually from the inside of the building, but requires a key for unlocking from the outside of the building. The barrier door typically opens inwardly to the building. The second door on the typical exterior doorway is referred to herein as an environmental door and may be a storm door, a screen door or a combination storm/screen door where a glass or plastic panel can be interchanged with a screen in response to seasonal changes in the environment. The environmental door typically is less sturdy than the barrier door, but often includes a latch to prevent unintended opening of the environmental door in response to wind forces. Many environmental doors also include a lock that permits locking from the inside. The typical environmental door is hinged on the same side of the doorway as the barrier door. However, the typical environmental door is hinged to rotate outwardly relative to the building.

The standard use of an inwardly hinged barrier door and an outwardly hinged environmental door leads to inconveniences during normal usage and creates complexities and costs during installation. For example, entrance into a building requires the initial outward opening of the environmental door. The environmental door then must be held in an open state while the barrier door is being opened. The opening of the barrier door may require access to and manipulation of a key while the environmental door is being held open. It is then necessary to pull the environmental door inwardly into a securely closed condition and then to push the barrier door outwardly into a securely closed condition.

Many environmental doors are provided with a closure-assist feature, such as a spring or a piston-cylinder assembly. These closure-assist features may avoid the need to securely pull the environmental door closed before pushing the barrier door closed. However, the closure assist features push the environmental door into the person who is trying to manipulate the handle and/or key for opening the barrier door.

The difficulties of opening doors in opposite directions, holding the environmental door open while accessing the barrier door and contending with an environmental door that is biased toward the closed position before the barrier door is opened all become much more complicated when parcels are being carried into the building. Thus, a person may have to simultaneously deal with holding parcels, maintaining the environmental door in a partly opened condition and unlocking the barrier door. Most closure assist features on environmental doors limit the extent of the hinged opening of the environmental door. Hence, the closure assist features may have to be disengaged to permit a full opening of the environmental door so that a large parcel can be carried through the doorway.

Most barrier doors are provided with two or three hinges arranged along a common rotational axis slightly inwardly from the interior side of the door frame. Most environmental doors also are provided with two or three hinges arranged along a rotational axis slightly outwardly from the exterior side of the door frame. The rotational axis for the environmental door should be substantially parallel to the rotational axis for the barrier door. Additionally, the door frame requires a precisely configured and installed framework to ensure proper seating of both the barrier door and the environmental door in their closed condition. The framework then must be routed out for receiving each of the respective hinges. The location, depth and alignment of the hinge recesses on the door frame are critical and require considerate time and skill to complete. The installer typically is required to perform at least four and often five or six precise routing operations on the doorway frame to install the door. Similar routing operations may be required along the edge of at least the barrier door to accommodate the other half of each hinge. The total cost of the door assembly includes the cost of at least four hinges and often five or six hinges. Furthermore, the total cost of the door assembly reflects the labor costs for installing the 4-6 hinges.

Door assemblies for institutional applications, such as prison doors, have been made with two doors hinged along the same side of a door. The doors open and hingedly rotate in the same direction, and can be opened separately or together. Examples of such doors are shown in U.S. Pat. No. 4,094,099; U.S. Pat. No. 4,302,907; U.S. Pat. No. 4,389,817; U.S. Pat. No. 4,891,906; U.S. Pat. No. 5,535,550 and U.S. Pat. No. 6,357,509. These prior doors that are hinged on the same side of a doorway and that open in the same direction all have certain structural and functional inefficiencies that make these prior doors undesirable for many residential or commercial applications.

In view of the above, it is an object of the subject invention to provide a door assembly that meets security and environmental needs without the above-described inefficiencies of conventional door assemblies used on residential or commercial buildings.

Another object of the invention is to provide a door assembly that is easier and less costly to install.

SUMMARY OF THE INVENTION

The invention relates to a door assembly that includes a barrier door and an environmental door. The barrier door may be formed from wood, metal, plastic and/or various combinations of these materials. The barrier door may be provided with or without windows. The door assembly further includes an environmental door that has a peripheral panel and a window opening. The peripheral panel may be formed from any of the above-referenced materials that can be incorporated into the barrier door. The environmental door further includes a window and/or a screen for substantially enclosing the window opening in the environmental door. The window may be formed from glass or plastic and the window and the screen may be interchangeable in response to environmental conditions.

The barrier door and the environmental door preferably are hinged to rotate about a single rotational axis. The rotational axis preferably is at or slightly inwardly from the interior side of a door frame. The barrier door and the environmental door are adapted to rotate separately or in unison relative to the door frame and to rotate in the same direction from a closed position to an open position. Preferably, the barrier door and the environmental door both will rotate inwardly from a closed position to an open position.

The barrier door preferably includes a handle assembly with a lock mechanism. The lock mechanism includes a lock bolt dimensioned and configured to be engaged selectively with a lock plate or a bolt opening formed in the frame of the doorway. The handle assembly may include an interior handle and an exterior handle. Each of the handles may include means for selectively locking the bolt in an extended position relative to the barrier door and in locked engagement with the door frame. The lock mechanism may be manually actuated from an interior side of the door assembly. However, the lock mechanism may require a key for opening the barrier door from outside of the door assembly.

The environmental door is configured to be substantially parallel to the barrier door when the barrier door and the environmental door at the same rotational position. The environmental door preferably has a handle access hole for receiving the exterior handle of the handle assembly when the barrier door and the environmental door are in the same rotational orientation. Additionally, the exterior handle is dimensioned to project a sufficient distance from the barrier door to pass through the handle access hole in the environmental door. Thus, the projection of the exterior door handle from the barrier door may exceed the projection of the interior handle from the barrier door.

The environmental door may include a closure for selectively closing the handle access hole. The closure may comprise a sliding panel positioned at the handle access hole. The sliding panel may be engaged releasably in a closed position by a sliding panel latch, but may be released for movement to an open position. Additionally the sliding panel for the handle access hole may be biased for movement from the closed position to the open position upon release of a sliding panel latch. Thus, the sliding panel will be urged automatically to the open position in those situations where a sliding panel is not latched into the closed position. Additionally, the sliding panel latch may be configured to release automatically in response to a direct contact between the exterior handle of the barrier door and the sliding panel. The contact may be achieved, for example, if an attempt is made to hingedly rotate one or both doors into the same orientation while the sliding panel of the handle access hole is in the closed position. The sliding panel functions to provide an appropriate environmental barrier when the barrier door is open and the environmental door is closed. For example, the sliding panel prevents insects from freely crossing the environmental door in those circumstances when the barrier door is opened and when a screen is employed in the environmental door to achieve air circulation.

The barrier door and the environmental door may include interengagement means for securing the barrier door and the environmental door together so that they may hingedly rotate in unison. The interengagement means may be used for extended periods of time, particularly during colder seasons.

The environmental door may have its own handle and its own latch for releasable engagement of the environmental door with the frame of the doorway. The latch can be released by directly manipulating a latch handle on the environmental door. However, the door assembly preferably includes means for preventing the environmental door and the barrier door from being latched together while the environmental door is latched to the frame of the doorway. Thus, a user will not have to perform the multiple steps of first unlocking the barrier door, disengaging the latch between the barrier and the environmental doors and then unlatching the environmental door to exit the building.

BRIEF DESCRIPTION OF THE DRAWINGS

FIG. 13 is a front elevational view of the environmental door showing both the latch assembly for the environmental door and the cover assembly for the handle access hole.

FIG. 14 is a cross-sectional view taken along line 14—14 in FIG. 13.

FIG. 15 is a cross-sectional view similar to FIG. 14, but showing the locking assembly on the barrier door disengaged from the environmental door.

DETAILED DESCRIPTION OF THE PREFERRED EMBODIMENT

Figure 1:
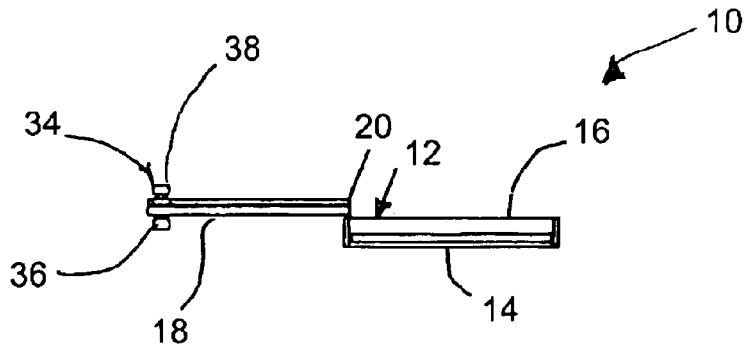
FIG. 1 is a top plan view of a door assembly in accordance with the subject invention with both doors in a fully opened position approximately 180° from a fully closed position.
Figure 2:
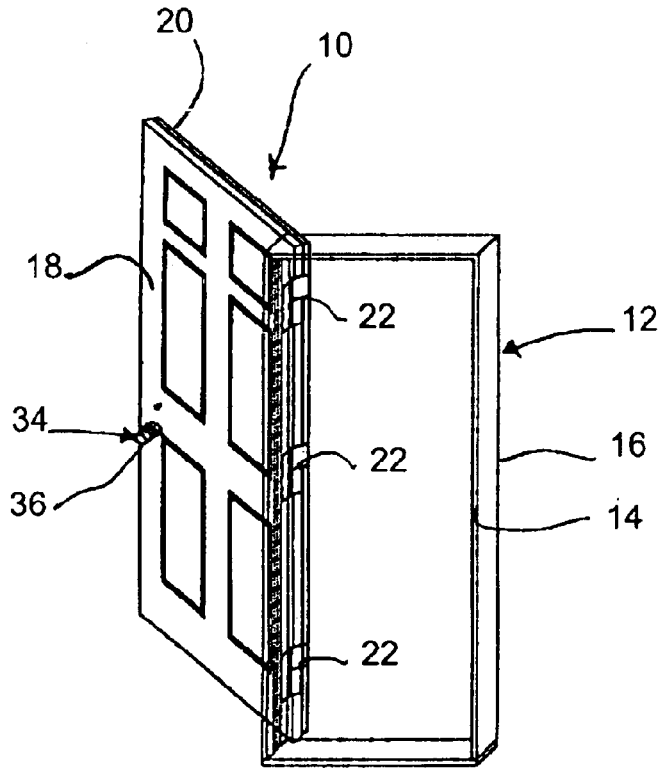
FIG. 2 is a perspective view of the door assembly with both doors rotated in unison slightly toward the closed position.
Figure 3:
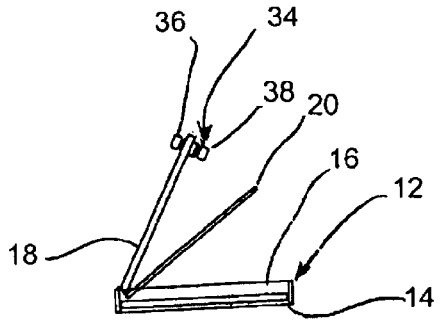
FIG. 3 is a top plan view of the door assembly with the barrier door open approximately 80° and the environmental door opened approximately 45°.
Figure 4:
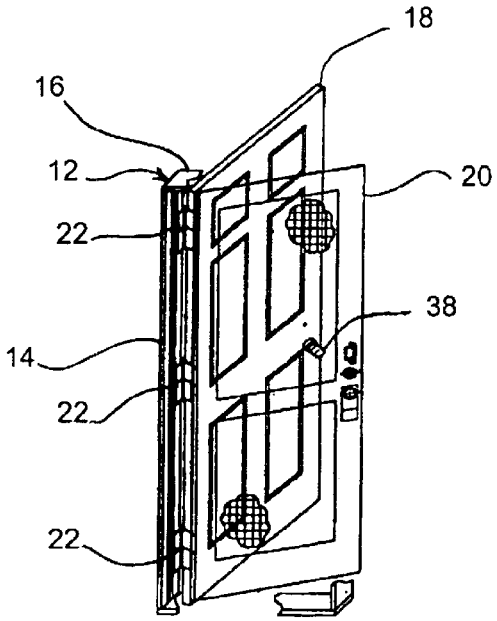
FIG. 4 is a perspective view of the door assembly in the condition shown in FIG. 3.
Figure 5:
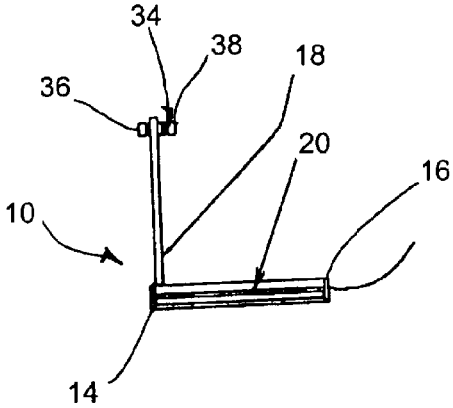
FIG. 5 is a top plan view of the door assembly with the environmental door fully closed and with the barrier door open approximately 90°.

A door assembly in accordance with the subject invention is identified generally by the numeral 10 in FIGS. 1–8. The door assembly 10 is mounted to a door frame 12 that typically will be secured in an exterior wall of a building. The door frame 12 has an exterior side 14 and an interior side 16.

The door assembly 10 includes a barrier door 18 and a screen door 20. Although a screen door 20 is illustrated herein, it is understood that other environmental doors may be employed, such as a storm door or a combination storm and screen door.

Figure 9:
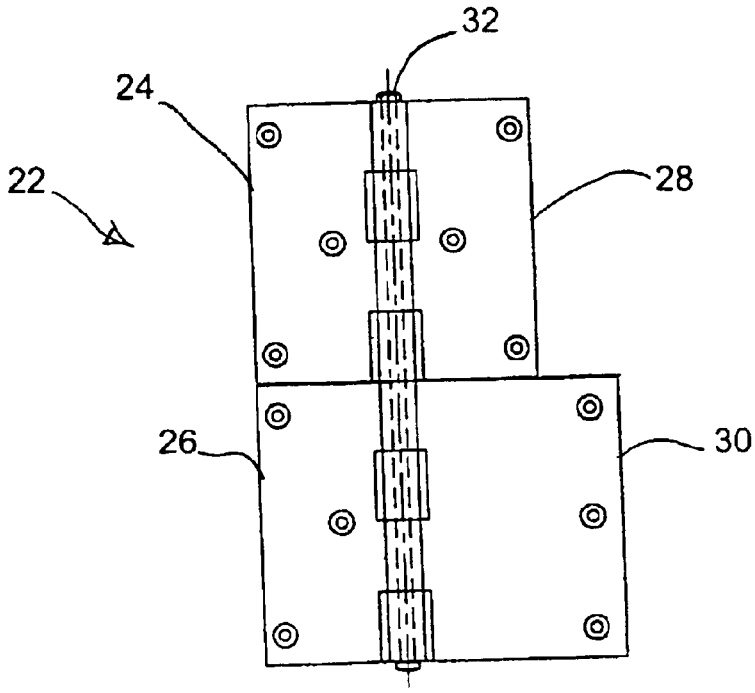
FIG. 9 is an elevational view of a hinge assembly that is part of the door assembly of the subject invention.

The barrier door 18 and the screen door 20 are mounted to the door frame 12 by a plurality hinge assemblies 22 disposed for rotation about a common axis. As shown most clearly in FIGS. 9 and 10, each hinge assembly 22 includes first and second frame mounting plates 24 and 26, a barrier door mounting plate 28 and a screen door mounting plate 30. The first frame mounting plate 24 is opposed to the barrier door mounting plate 28, while the second frame mounting plate 26 is opposed to the screen door mounting plate 30. As shown herein, the frame mounting plates 24 and 26 are separate. However, a single frame mounting plate can be provided. Each of the mounting plates 24–30 is formed with at least two cylinders for receiving a hinge pin 32. The cylinders of the barrier door mounting plate 28 and the screen door mounting plate 30 are interengaged with the cylinders of the frame mounting plates 24 and 26 so that all of the respective cylinders are disposed along a common axis and receive the hinge pin 32. The frame mounting plates 24 and 26 extend to substantially equal widths from the hinge pin 32 and are formed with an array of apertures for receiving screws so that the hinge assembly 22 can be mounted to the door frame 12. The barrier door mounting plate 28 defines a width substantially equal to the widths of the frame mounting plates 24 and 26. Additionally, the barrier door mounting plate 28 is formed with a plurality of apertures for receiving screws so that the barrier door mounting plate 28 can be secured to an edge of the barrier door 18.

The screen door mounting plate 30 is wider than any of the other mounting plates of the hinge assembly 22. More particularly, the hinge door mounting plate 30 defines a width approximately equal to the sum of the width of the barrier door 18, the width of the screen door 20, the width of the spacing between the doors 18 and 20 plus an offset between the hinge pin 32 and the barrier door 18. The screen door mounting plate 30 further includes apertures for receiving screws to secure the screen door mounting plate 30 to the screen door 20.

In the illustrated embodiment of FIGS. 1–8, three hinge pin assemblies 22 are mounted to the door frame 12 and to the doors 18 and 20 at substantially equal spacings along the longitudinal side edges of the barrier door 18 and the screen door 20. However, some door assemblies may require only two hinge assemblies 22.

Figure 10:
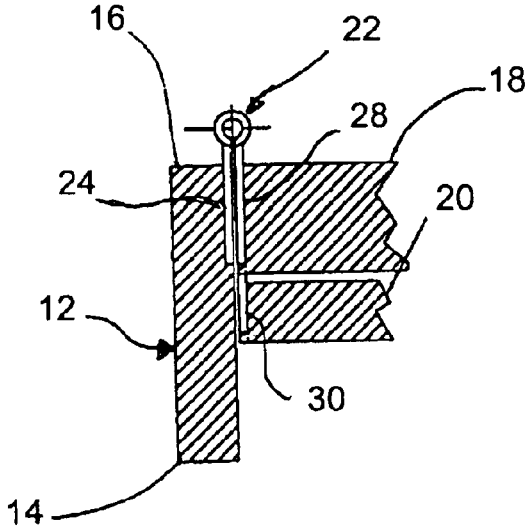
FIG. 10 is a cross-sectional view taken along line 10—10 in FIG. 8.

The hinge assemblies 22 enable the barrier door 18 and the screen door 20 to be in the closed position shown most clearly in FIG. 10 with the first frame mounting plates 24 substantially opposed to the barrier door mounting plates 28 and with the second frame mounting plates 26 opposed to the inner portions of the screen door mounting plates 30. However, the hinge assemblies 22 further enable the barrier door 18 and the screen door 20 to be rotated either separately or in unison as shown in FIGS. 1–8.

The barrier door 18 further includes a handle assembly 34. The handle assembly 34 may be of substantially conventional design with an interior handle 36, an exterior handle 38, a spindle (not shown) extending between the handles 36 and 38 and a lock mechanism identified generally by the numeral 40 in FIG. 12. The handle assembly 34, however, differs from a conventional handle assembly in that the projection of the exterior handle 38 from the barrier door 18 exceeds the projection of the interior handle 36 from the barrier door 18.

Figure 12:
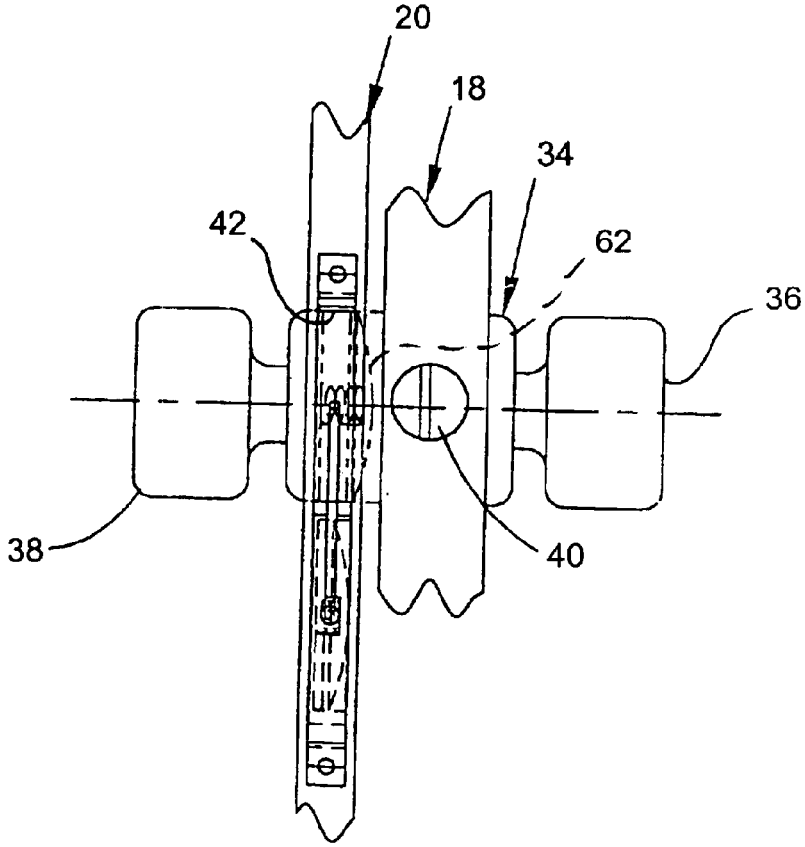
FIG. 12 is a side elevational view showing the door assembly closed and the exterior handle of the barrier door passing through the handle access hole.

The screen door 20 is provided with a handle access hole 42 at a location in the screen door 20 to align with the exterior handle 38 of the barrier door 18 when the barrier door 18 and the screen door 20 are substantially adjacent and parallel, as shown in FIG. 12. Thus, the exterior handle 38 of the barrier door 18 can pass through the handle access hole 42 so that the exterior handle 38 can be accessed from the exterior side 14 of the door frame 12 when the barrier door 18 and the screen door 20 both are closed.

Figure 11:
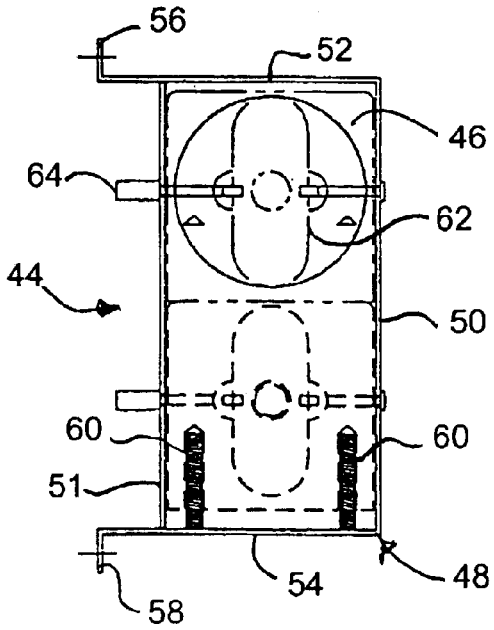
FIG. 11 is a front elevational view of the cover assembly for the door handle access hole in the environmental door.

There will be many instances where it is desired to keep the barrier door 18 open while the screen door 20 remains closed. The screen in the screen door 20 will prevent insects from passing into the building on which the door assembly 10 is mounted. However, the handle access hole 42 could permit insects to bypass the screen and fly into the interior of the building. To prevent such access by insects, the screen door 20 is provided with a cover assembly 44 as shown in FIG. 11. The cover assembly 44 includes a cover 46 slidably mounted in a housing 48. The housing 48 includes parallel first and second vertical supports 50 and 51. Upper and lower horizontal supports 52 and 54 extend horizontally across the opposite upper and lower ends of the vertical supports 50 and 51. Mounting flanges 56 and 58 extend respectively from the ends of the upper and lower horizontal supports 52 and 54 spaced from the vertical supports 50 and 51 and are aligned substantially parallel to the vertical supports 50 and 51. The cover assembly 44 is mounted in an opening that is prepared in the edge of the screen door 20 at a location aligned with the handle access hole 42. More particularly, the cover assembly 44 is mounted so that the upper horizontal support 52 is slightly above the handle access hole 42. The mounting flanges 56 and 58 then are secured to the edge of the screen door 20.

The cover 46 can be moved within the frame 48 between an upper position where the cover 46 closes the handle access hole 42 and a lower position where the cover 46 is below the handle access hole 42. The cover assembly 44 further includes a pair of coil springs 60 for biasing the cover 46 toward the lower open position. Additionally, a bowed leaf spring 62 is provided on cover 46 for releasably engaging handle access hole 42 and holding the cover 46 in the upper closed position and against the biasing forces exerted by the coil springs 60. An actuator 64 projects from cover 46 and passes through a slot vertical support 51 to enable manual movement of cover 46.

It is expected that attempts may be made to close the barrier door 18 relative to the screen door 20 while the cover 46 is in the upper closed position. Hence, the exterior handle 38 will contact the cover 46. As a result, the cover 46 should be formed from a fairly rigid and unbreakable material, such as a shatterproof lexan. Additionally, the leaf spring 62 faces barrier door 18 and will deflect out of engagement with the handle access hole 42 when struck by exterior handle 38 of the barrier door 18. Accordingly, an attempt to close the barrier door 18 while the cover 46 is in the closed position relative to the handle access hole 46 will cause the leaf spring 62 to be released and will enable the springs 60 to urge the cover 46 down toward the open position. The cover 46 can be moved selectively between the closed and open position by manually gripping an actuator projection 64 that extends rigidly from the cover 46 and through the slot in the exterior vertical support 51. Thus, the actuator projection 64 is accessible along the edge of the screen door 20.

The screen door 20 further includes a latch 66 so that the screen door can be locked in the closed position when the barrier door 18 is in the opened position. The latch is mounted near the edge of the screen door 20 at a location above the handle access hole 42. The latch 66 includes a rotatable handle 68 that can be recessed at least partly into the inner face of the screen door 20 and that can be rotated approximately 90° for moving a latch element 70 into a latch recess (not shown) in the door frame 12. Rotation of the screen door latch handle 68 in the opposed direction will retract the latch element 70 from the lock recess in the door frame 12, and hence will permit the screen door 20 to be opened.

Figure 6:
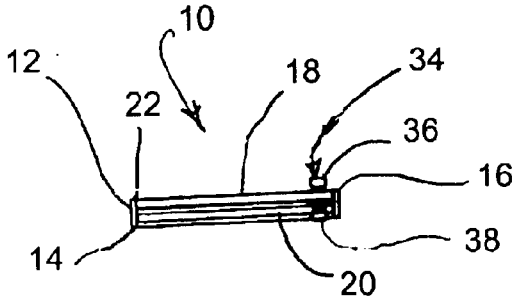
FIG. 6 is a top plan view of the door assembly with both doors in the fully closed condition.
Figure 7:
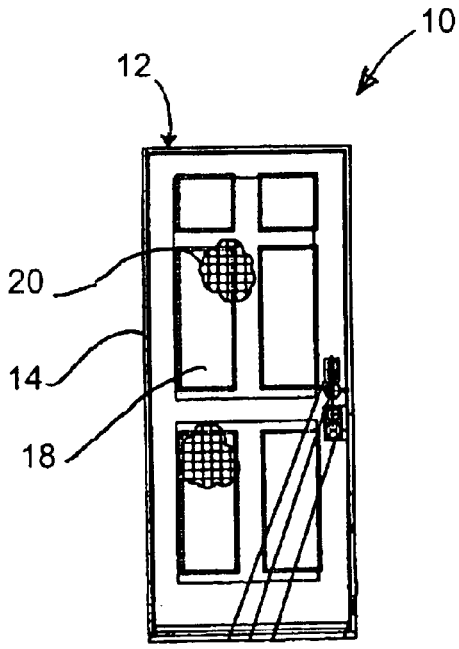
FIG. 7 is a front elevational view of the door assembly in the fully closed orientation shown in FIG. 6.
Figure 8:
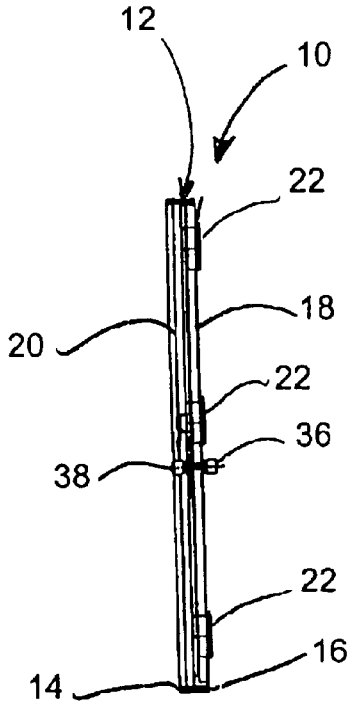
FIG. 8 is a side elevational view of the door assembly in the orientation of FIGS. 6 and 7.

The door assembly 10 further includes an interlocking latch 72 for selectively latching the barrier door 18 to the screen door 20 so that the barrier door 18 and the screen door 20 can be rotated in unison from the open position (FIG. 1) to the closed position (FIGS. 6–8). The interlocking latch 72 includes a latch pin 74 that is aligned to extend through the barrier door 20 at a location substantially aligned with the screen door latch 66. The exterior end of the latch pin 74 includes a transversely extending latch element 76. The interior end of the latch pin 74 includes an interlocking latch handle 78 dimensioned to be manipulated by hand. A spring 80 surrounds the latch pin 74 and biases the latch pin 74 inwardly. The latch element 76 at the exterior end of the latch pin 74 can be passed through an opening in the screen door latch 66 when the screen door latch 66 is in the unlocking position. However, the handle 68 of the screen door latch 66 prevents the latch element 76 of the interlocking latch 72 from engaging the screen door 20 when the screen door latch 66 is in the locking position. Thus, it is not possible to latch the barrier door 18 to the screen door 20 when the screen door 20 is locked to the door frame 12. Hence, there will not be a situation where it is necessary to first open the barrier door 18 and then unlock the screen door 20. Rather, in those situations where the barrier door 18 is to be locked to the door frame 12, the screen door 20 must first be unlocked from the door frame 12.

What is claimed is:

1. A door assembly comprising a barrier door rotatable about an axis of rotation and an environmental door rotatable about the axis of rotation of the barrier door, the barrier door and the environmental door being selectively rotatable independently of one another, the barrier door and the environmental door further including an interlocking means for releasably interlocking the barrier door and the environmental door together so that the barrier door and the environmental door can be rotated in unison about the axis of rotation of the barrier door, the environmental door having a handle access hole passing therethrough and the barrier door having a handle passing through the handle access hole when the barrier door and the environmental door are latched together so that the barrier door and the environmental door can be opened in unison by the handle when the barrier door and the environmental door are latched together, wherein the environmental door further includes a cover for selectively closing the handle access hole, so that the handle access hole can be closed to provide an environmental barrier when the barrier door and the environmental door are in different rotational positions.

2. The door assembly of claim 1, further comprising an actuator for manually moving the cover between opened and closed positions relative to the handle access hole.

3. The door assembly of claim 2, wherein the cover is aligned for vertical movement in the environmental door with the closed position being gravitationally above the opened position so that the cover is gravitationally biased towards the opened position.

4. The door assembly of claim 3, wherein the cover further includes holding means for releasably holding the cover in the closed position and against gravitational forces using the cover towards the opened position.

5. The door assembly of claim 4, wherein the holding means for releasably holding the cover in the closed position is configured such that engagement of the cover by the handle releases the holding means and permits the cover to be moved gravitationally to the opened position.

6. The door assembly of claim 1, further comprising an environmental door lock on the environmental door and movable between an unlocked position where the environmental door can be opened relative to a door frame and a locking position where the environmental door is releasably locked to the door frame, the environmental door lock being configured to prevent interlocking of the environmental door and the barrier door when the environmental door lock is in the locking position.

7. The door assembly of claim 6, wherein the interlocking means for releasably interlocking the barrier door and the environmental door includes an interlocking opening formed in the environmental door and an interlocking latch movably mounted in the barrier door, the interlocking latch being disposed and configured for entering into he interlocking opening in the environmental door for releasably engaging the environmental door, the environmental door lock being configured for covering the interlocking opening in the environmental door when the environmental door lock is in the locking position.

8. The door assembly of claim 1, further comprising a plurality of barrier door hinges, each said barrier door hinge having a barrier door hinge plate and a first frame hinge plate hingedly rotatable about a barrier door hinge pin, the environmental door having plurality of environmental door hinges, each of said environmental door hinges having an environmental door hinge plate and a second frame hinge plate hingedly connected to one another about an environmental door hinge pin.

9. The door assembly of claim 8, wherein each of said barrier door hinges is substantially adjacent to one of said environmental door hinges, and wherein each of said barrier door hinge pins is unitary with one of said environmental door hinge pins.

10. The door assembly of claim 9, wherein each said of first frame hinge plates is formed unitarily with one of said second frame hinge plates.

11. The door assembly of claim 1, further comprising a frame hingedly connected to both the barrier door and the environmental door.

12. A door assembly comprising:

a frame having plurality of frame hinge plates mounted thereon and defining a single axis of rotation;

a barrier door having a plurality of barrier door hinge plates hingedly engaged with the frame hinge plates for rotation about the axis of rotation between a closed position relative to the same and open positions relative to the frame, the barrier door including a handle;

an environmental door having environmental door hinge plates hingedly connected to the frame hinge plates for rotation about the axis of rotation independently of the rotation the barrier door about the axis of rotation, the environmental door having environmental door lock movable between an unlock position where the environmental door can be opened relative to the frame and a locking position where the environmental door is releasably locked to the frame, the environmental door including a handle hole for receiving the handle of the barrier door and a cover for releasably covering the handle hole in the environmental door; and an interlocking means for releasably interlocking the barrier door and the environmental door together for rotation about the axis of rotation in unison, the environmental door lock and the interlocking means being configured for preventing interlocking of the barrier door and the environmental door when the environmental lock is in the locking position.

13. The door assembly of claim 12, wherein the barrier door further includes a barrier door lock for releasably locking the barrier door to the frame when the barrier door is in the closed position relative to the frame.

14. The door assembly of claim 12, wherein the environmental door includes holding means for releasably holding the cover in a position for closing the handle hole and biasing means for biasing the cover away from the handle hole when the holding means for the cover is released.

* * * * *